US007185757B2

(12) United States Patent
Ishino et al.

(10) Patent No.: US 7,185,757 B2
(45) Date of Patent: Mar. 6, 2007

(54) SHOE PRESS BELT

(75) Inventors: Atsushi Ishino, Tokyo (JP); Masanori Morokawa, Tokyo (JP); Toshimi Abiko, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 186 days.

(21) Appl. No.: 11/091,141

(22) Filed: Mar. 28, 2005

(65) Prior Publication Data

US 2005/0211533 A1 Sep. 29, 2005

(30) Foreign Application Priority Data

Mar. 26, 2004 (JP) ..... 2004-091505

(51) Int. Cl.
*B65G 15/34* (2006.01)

(52) U.S. Cl. ..... 198/847; 162/358.4; 162/901

(58) Field of Classification Search ..... 198/846, 198/847; 162/358.4, 901, 902, 904, 358.3; 156/184

See application file for complete search history.

(56) References Cited

U.S. PATENT DOCUMENTS

| | | | | |
|---|---|---|---|---|
| 4,311,474 | A * | 1/1982 | Standley | 198/847 |
| 4,877,472 | A * | 10/1989 | Rodal | 162/901 |
| 5,134,010 | A * | 7/1992 | Schiel | 198/847 |
| 5,943,951 | A * | 8/1999 | Muellner et al. | 198/847 |
| 6,699,368 | B2 * | 3/2004 | Ishii et al. | 162/358.4 |
| 6,736,939 | B2 * | 5/2004 | Watanabe | 162/358.3 |
| 6,921,461 | B2 * | 7/2005 | Watanabe et al. | 162/358.4 |
| 6,929,718 | B2 * | 8/2005 | Kimura | 162/358.4 |

FOREIGN PATENT DOCUMENTS

| | | |
|---|---|---|
| JP | 64-45888 | 2/1989 |
| JP | 1-503315 | 11/1989 |
| JP | 1-298292 | 12/1989 |
| JP | 3-57236 | 8/1991 |
| JP | 5-505428 | 8/1993 |
| JP | 8-209578 | 8/1996 |
| JP | 2000-303377 | 10/2000 |
| JP | 3213589 | 7/2001 |
| JP | 2002-194855 | 7/2002 |
| JP | 3408416 | 3/2003 |

* cited by examiner

*Primary Examiner*—James R. Bidwell
(74) *Attorney, Agent, or Firm*—Howson & Howson LLP

(57) ABSTRACT

A shoe press belt comprises a shoe side layer, a base body on the external circumference of the shoe side layer, and a wet paper web side layer formed on the external surface of the base body. The shoe side layer is formed on mandrel having a polished surface, and the base body comprises a lattice material made by joining crossing points of warp and weft yarns, and a wound layer made by winding a thread in a helix. The lattice material, made by joining the crossing points of the warp and weft yarns as a component of the base body, has smaller undulations than those of a woven material.

20 Claims, 5 Drawing Sheets

SHOE PRESS BELT

FIELD OF THE INVENTION

This invention relates to a belt used in a shoe press mechanism such as a shoe press for papermaking, and especially to a belt adapted for use in a closed-type shoe press.

BACKGROUND OF THE INVENTION

In papermaking, the use of shoe presses is on the increase because they contribute to a reduction in the total manufacturing cost. Furthermore, there is a trend toward the use of a closed type shoe press because it requires less space and avoids scattering of oil.

Compared to conventional belts used in open type shoe presses, belts used in a closed type shoe press are subject to more severe conditions, especially in terms of papermaking speed and nip pressure. Accordingly there has been a strong demand by users for improvement in belt durability.

Among typical technologies used for producing belts for closed type shoe presses, various manufacturing technologies using mandrels are known. For example, Examined Japanese Patent Publication No. 57236/1991, and Unexamined Japanese Patent Publication No. 45888/1989, disclose a manufacturing method using an endless woven fabric as a core member. In addition, Japanese Patent No. 3213589 discloses a manufacturing method using an endless mesh for a core member. However, these manufacturing methods have deficiencies, especially difficulties encountered in adjusting the machine direction dimension of a belt being produced.

In addition, PCT Patent application No. 503315/1989, and Unexamined Japanese Patent Publication No. 209578/1996, disclose a manufacturing method wherein a woven fabric is not used. These manufacturing methods form threads in the axial direction of a mandrel at regular intervals around the entire circumference of the mandrel. However, it is difficult to position the threads substantially parallel to the axial direction of the mandrel, and to avoid loosening of the threads under tensile force. With these methods excessive time is required for forming the threads.

Unexamined Japanese Patent Publication No. 298292/1989, and PCT Patent application No. 505428/1993, disclose a manufacturing method wherein a mat-shaped fiber band or a woven fabric impregnated with uncured resin is wound in a helix and then cured. However, with these manufacturing methods, exfoliation can easily occur at joints of the helix.

FIGS. 10(*a*) and 10(*b*) show a manufacturing method for a conventional shoe press belt. An endless woven fabric C is arranged on two rolls A and B, and impregnated and coated on an external surface of the woven fabric C by a coating apparatus D to form a shoe side layer, which is then cured. After curing of the shoe side layer, the endless woven fabric C is removed from the rolls A and B, turned inside-out, and reset on the rolls with its original inner surface facing outward. The fabric is again impregnated and coated to form a wet paper web side layer. The wet paper web side layer is cured, its thickness is adjusted, and concave grooves G are formed in its outer surface to produce a belt 1 is obtained, as shown in FIG. 10(*b*).

The above-described conventional method had two principal deficiencies. First, in order to impregnate and coat the shoe side layer E on one surface of the endless woven fabric and the wet paper web side layer F on the other side, the belt needed to be reversed, and reversal caused distortion to occur inside the belt. Second, since the distortion that existed when weaving the endless woven fabric is released as the resin is cured. Release of this distortion results in instability of the form of the belt, enabling flapping of the belt to occur.

Japanese Patent No. 3408416, and Unexamined Japanese Patent Publication No. 303377/2000, disclose a manufacturing method wherein a first resin layer is formed on a mandrel followed by formation of a base body around the external circumference of the resin layer, and formation of another resin layer, which is connected with first resin layer through the base body. According to this manufacturing method, after forming the first resin layer, there is no need to grind or reverse the resin layer, and therefore manufacturing efficiency and productivity can be improved.

The shoe press belt manufactured according to the manufacturing method disclosed in the Japanese Patent No. 3408416 has relatively large undulations at the joints of the warp yarns and weft yarns in the woven fabric used as its base body. In the use of the belt, these undulations result in large stress concentration at the joints of the warp yarns and weft yarns, which can result in cracking of a resin layer, and impairment of the durability of the belt.

In the case of a manufacturing method disclosed in Unexamined Japanese Patent Publication No. 303377/2000, similarly to the methods disclosed in PCT Patent application No. 503315/1989 and Unexamined Japanese Patent Publication No. 209578/1996, threads have to be formed in the axial direction of the mandrel at regular intervals, and be distributed around the entire circumference of the mandrel. The need for this arrangement of threads causes manufacture of the belt to be very time consuming and labor intensive.

It is an object of the invention to address the above-described problems, and to provide a shoe press belt that exhibits high crack resistance, and that can be produced efficiently.

SUMMARY OF THE INVENTION

The shoe press belt in accordance with the invention comprises a base body, a wet paper web side layer on one side of the base body and a shoe side layer on the opposite side of the base body. The shoe side layer is formed on a mandrel having a polished surface. The base body comprises a lattice material comprising warp yarns and weft yarns crossing one another at crossing points and joined at the crossing points, and a layer comprising thread wound in a helix.

Preferably the warp yarns are disposed between two layers of weft yarns pinched by the weft yarns, and the warp and weft yarns are joined at the crossing points by an adhesive comprising a resin or by a thermal bond.

The weft yarns of the lattice material preferably have a higher strength than that of the warp yarns, and the weft yarns preferably extend along the axial direction of the mandrel during the formation of the belt. The number of weft yarns of the lattice material is preferably more than double the number of warp yarns in the lattice material.

The lattice material may be wound onto the mandrel in a single sheet having a width slightly greater than the circumference of the shoe side layer on the mandrel. Alternatively, the lattice material can be wound onto the mandrel in a helix, or applied to the mandrel in plural sheets positioned on the mandrel with their edges overlapping one another in the widthwise direction.

Another aspect of the invention is the method of making a belt for use in a shoe press wherein the belt passes between a press roll and a shoe, comprising forming a shoe-side layer on a mandrel having a polished surface, forming a base body on the shoe side layer while the shoe side layer is on the mandrel, by placing, around the mandrel, a lattice material comprising warp yarns and weft yarns crossing one another at crossing points and joined at the crossing points, and also winding thread in a helix about the mandrel, and forming a wet paper web side layer on the base body.

According to the invention, by using the lattice material made by joining the crossing points of warp yarns and weft yarns as a component of the base body, undulations of the warp yarns and weft yarns can be made relatively small. Accordingly, cracking on a resin layer during use of the belt can be prevented and the durability can be improved. In addition, since there is no need to form thread in the axial direction of the mandrel, productivity can be remarkably improved.

BRIEF DESCRIPTION OF DRAWINGS

FIG. 2(*b*) is a perspective view corresponding to FIG. 2(*a*);

FIG. 10(*b*) is a partial cross-sectional view of a shoe press belt produced by the conventional method.

DETAILED DESCRIPTION OF THE PREFERRED EMBODIMENTS

Figure 1:
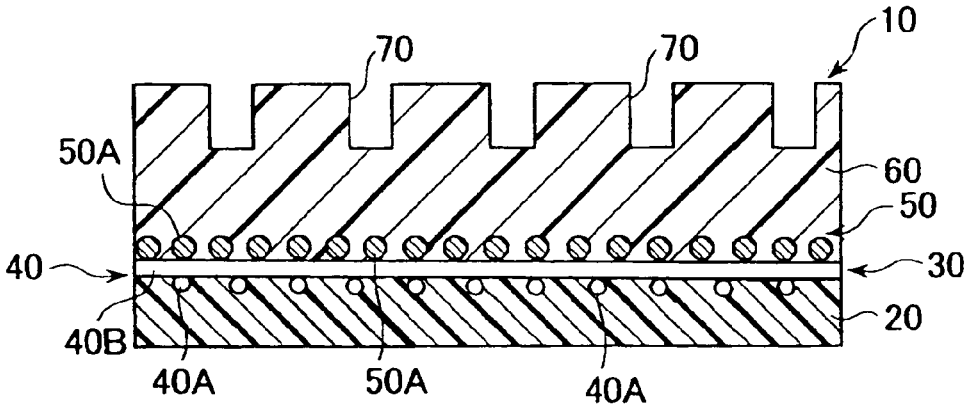
FIG. 1 is a transverse cross-sectional view of a part of a shoe press belt according to the invention.

As shown in FIG. 1, a shoe press belt 10 according to the invention comprises a shoe side layer 20, a base body 30, and a wet paper web side layer 60. The shoe side layer 20 is formed on the polished surface of a mandrel M (FIG. 2(*b*)), and consequently, the shoe side layer 20, when formed on the mandrel, is in the form of a closed loop, having an inner circumferential surface which is in contact with the mandrel, and an outer circumferential surface. The base body 30 is disposed on the outer circumferential surface of the shoe side layer 20, and the web side layer 60 is disposed, in turn, on the outer circumferential surface of the base body 30.

The base body 30 comprises a lattice material 40, composed of warp yarns 40A and weft yarns 40B, joined at their crossing points, and a wound layer 50 composed of a thread 50A wound in a helix.

Figure 2A:
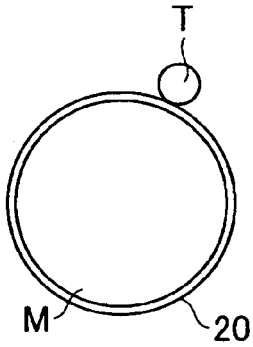
FIG. 2(*a*) is a cross-sectional view illustrating the process of forming the shoe side layer of the belt on a mandrel.
Figure 2B:
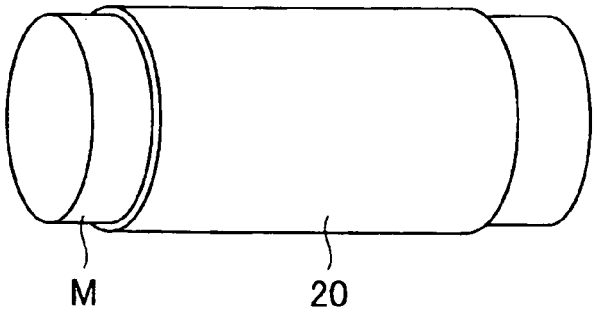

Before the shoe side layer 20 is applied to the mandrel, the mandrel is pre-coated with a suitable remover material, or, alternatively a removing sheet (not shown) is applied to the surface of the mandrel. As shown in FIG. 2(*a*), the shoe side layer 20 is formed on the mandrel M to a thickness preferably in the range from about 0.5 mm to 2.0 mm by means of a coating apparatus T, which can be a doctor bar, a coater bar, or the like).

Figure 3:
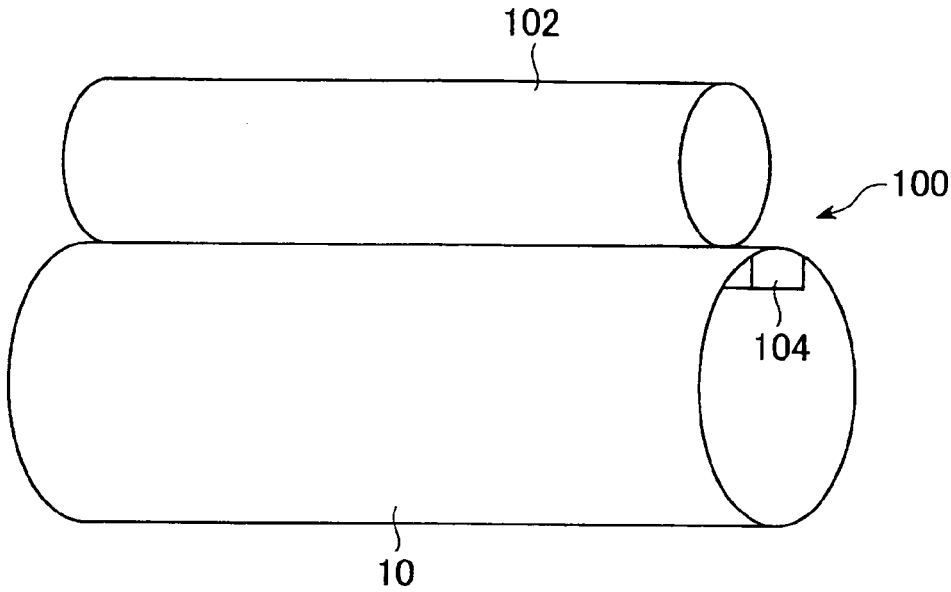
FIG. 3 is a perspective view of a shoe press mechanism using the shoe press belt according to the invention.

Since the shoe press belt 10 according to the invention, when in use, as shown in FIG. 3, passed between a press roll 102 and a shoe 104 in a shoe press mechanism 100, the shoe side layer 20, which forms the innermost layer of the belt requires a high degree of smoothness, as it is constantly in close sliding contact with the shoe 104. The required smoothness of the inner surface of the belt can be ensured by using a mandrel M having a polished surface, and, when the belt is formed in this manner, there is no need for post-processing to achieve improved smoothness.

Polishing the surface of the mandrel M not only ensures smoothness of the inner surface of the belt 10, but also for facilitates removal of the shoe press belt from the mandrel. The mandrel M preferably includes a heater (not shown) which facilitates curing of the resin of the belt, including the resin of the shoe side layer 20.

After the shoe side layer 20 is formed on the mandrel, the base body 30 is formed on the external circumference of the shoe side layer 20. For the lattice material 40, which is composed of warp yarns 40A and weft yarns 40B, joined at their crossing points, a material such as disclosed in unexamined Japanese Patent Publication No. 194855/2002 may be used. This patent publication describes a lattice-like material composed of a warp layer disposed between two weft layers, in which the warp includes carbon fiber yarn and alkali-proof organic fiber yarn respectively impregnated with resin, and the weft includes both the carbon fiber yarn and the organic fiber yarn or only the organic fiber yarn.

Figure 4:
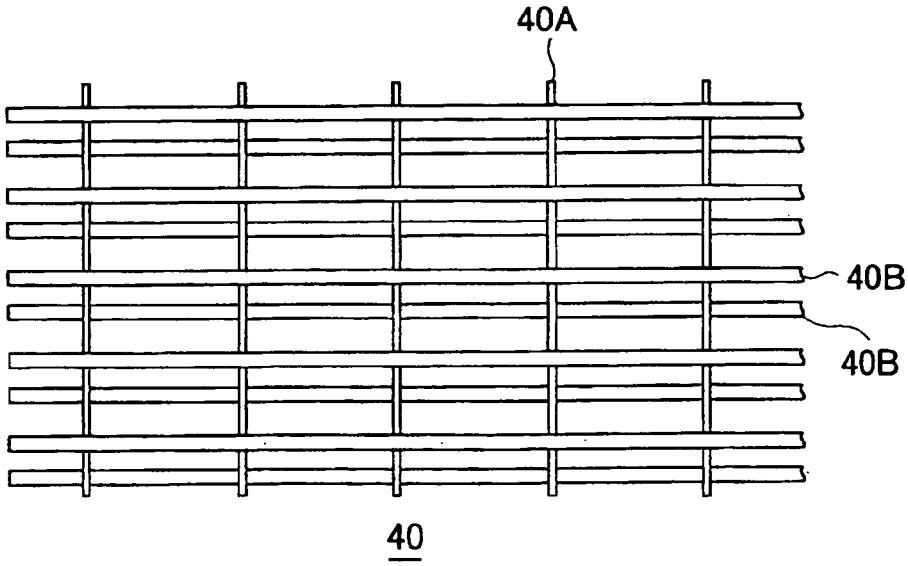
FIG. 4 is a plan view of a part of the lattice material of the base body of the belt.

As shown in FIG. 4, warp yarns 40A are pinched by the weft yarns 40B, which have a higher strength than that of the warp yarns 40A. That is, the weft yarns have a greater tensile strength than the warp yarns. The warp yarns 40A and the weft yarns 40B are joined at their crossing points by adhesion, using a suitable resin as a glue, by thermal bonding, or by another suitable means.

An example of a method of forming the base body 30 will be explained with reference to FIG. 1 and FIGS. 5–7. After forming the shoe side layer 20, a layer of the lattice material 40, comprising plural sheets, is positioned on the external circumference of the shoe side layer in such a way that the weft yarns 40B, which have a higher strength than that of the warp yarns 40A, extend along the axial direction of the mandrel M. Pulling apparatus (not shown) may be provided at both ends of the mandrel M, for applying an even tensile force to pull the lattice material 40 as it is applied to the shoe side layer. The weft yarns 40B are disposed along the axial direction of the mandrel M so that the shoe press belt has a high strength and dimensional stability in the widthwise (i.e., cross-machine) direction. As an alternative, a lattice material comprising warp yarns and the weft yarns which have the same strength can be used. However, in this case, the number of weft yarns in the lattice material should be more than double the number of warp yarns.

Figure 5:
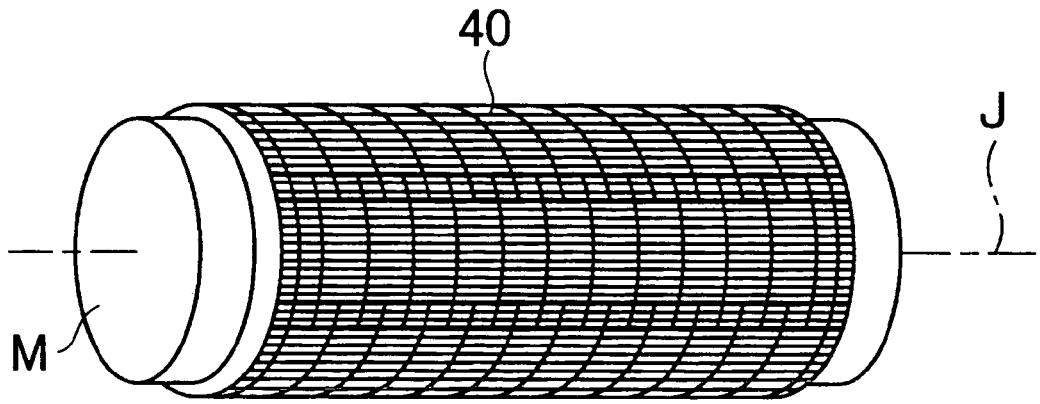
FIG. 5 is a perspective view showing the process of positioning a lattice material comprising plural sheets on the external circumference of a shoe side layer formed on the surface of the mandrel.

To improve the strength of the belt, it is preferable to position the plural sheets of lattice material 40 on the mandrel M so that their lengthwise dimension is parallel to the axis of the mandrel, and so that the edges of the sheets overlap one another in the widthwise direction (that is, the circumferential direction), as shown in FIG. 5. Even when the edges of the sheets of lattice material 40 overlap, because the warp and weft yarns of the material have relatively small undulations in comparison with a conventional woven fabric, there is a reduced tendency for cracks to form in the resin layers of the belt during use.

Figure 6:
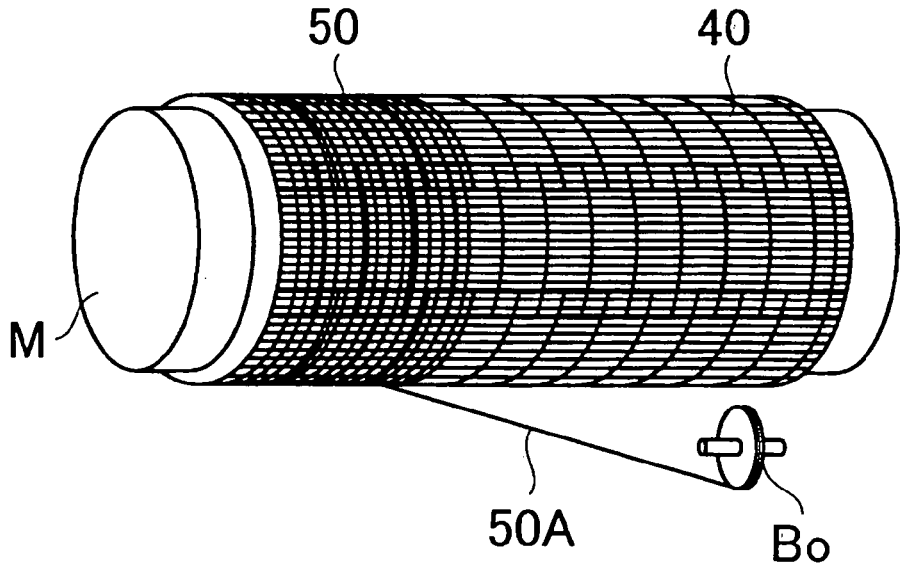
FIG. 6 is a perspective view showing the process of winding the thread layer.

The lattice material 40 of the base body of the belt may be composed of only a single sheet, in which case it can be easier to pull and fix the lattice material under even tensile force by means of a pulling apparatus provided at both ends of the mandrel M. However, as shown in FIG. 4, the base body preferably comprise plural sheets, which can be easily positioned. As a further alternative, an elongated sheet of lattice material can be wound in a helix on the shoe side layer 20. Also in this case, in order to improve the strength of the belt, it is preferable to wind the lattice material so that the edges of successive turns overlap one another in the widthwise direction. Next, wound layer 50 is formed by winding a thread in a helix onto the external surface of the lattice material 40. As shown in FIG. 6, layer 50 is formed by winding a thread 50A, which is led out from a bobbin BO installed in a thread supplier (not shown), in a helix about the circumference of the base body 30. This may be accomplished by rotating the mandrel M, while guiding the thread so that it is wound onto the lattice in a helix extending from one end of the lattice layer to the other. Alternatively, the wound layer can be produced by rotating the mandrel while moving a mobile thread supplier so that the bobbin moves parallel to the mandrel axis. As a further alternative, several threads may wound onto the lattice in plural helical stripes, using one bobbin for each thread. The wound layer 50 provides the shoe press belt with a high degree of strength in the machine direction.

Figure 7:
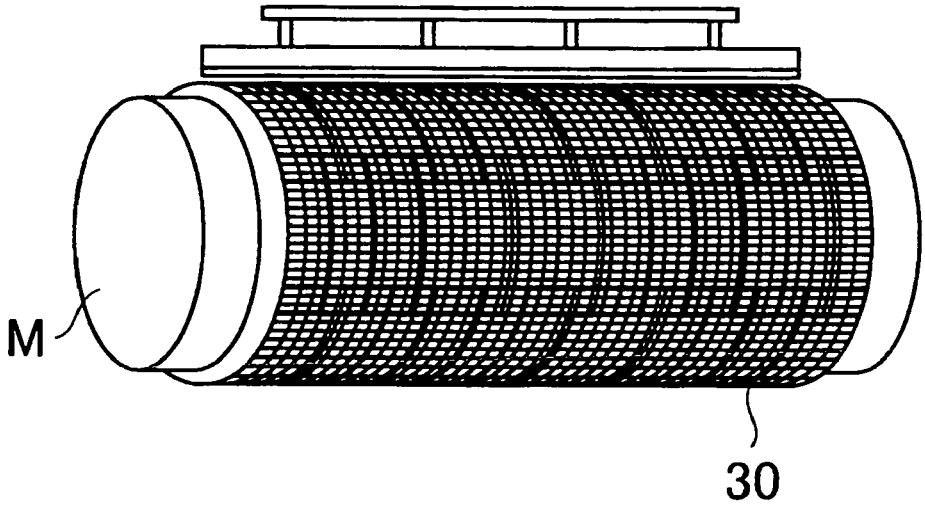
FIG. 7 is a perspective view showing the process of filling after winding the thread layer.

After forming the wound layer 50, as shown in FIG. 7, the base body 30 is completed by coating it with resin to an extent such that gaps between the lattice material 40 and the wound layer 50 are filled. This coating step is preferably carried out while rotating the mandrel M. The resin in this case is preferably heated so that its viscosity decreases to a degree such that it can be easily impregnated into gaps between the lattice material 40 and the wound layer 50.

In the embodiments described above, one layer of lattice material 40 is provided on the external surface of the shoe side layer 20, and the wound layer 50 is then formed on the external surface of the lattice material 40. However, the invention is not necessarily limited to this arrangement of the lattice material 40 and the wound layer 50. Various other arrangements may used. For example, the wound layer can be formed first, and the lattice material can then be positioned on the outside of the wound layer. Alternatively, plural layers of the lattice material 40 can be provided. In a further alternative, a first wound layer can be formed on the shoe side layer, and then, after positioning the lattice material on the first wound layer, another wound layer can be formed. In still another alternative, a first layer of lattice material can be positioned on the shoe side layer, a wound layer can be formed on the first lattice layer, and then one or more further layers of lattice material can be applied on the outside of the wound layer. Still other variations can be used which are similar to those described, including other variations incorporating plural layers of lattice material. When applying plural layers of lattice material, it is preferable to position then so that, in any given layer, parts of lattice sheets which overlap in the widthwise are not directly over or under overlapping parts of another layer.

Following completion of the base body, an endless wet paper web side layer 60 is formed on the external circumference of the base body. Resin forming the wet paper web side layer 60 flows through the base body 30 comprising the lattice material 40 and the wound layer 50, and connects with the external surface of the shoe side layer 20, thereby integrating the shoe side layer, the base body, and the web side layer. Although the shoe side layer 20 and the wet paper web side layer 60 are usually integrated with each other naturally, the extent of their integration may be improved using a primer or an adhesive agent when necessary.

The resin used for the shoe side layer 20 and the wet paper web side layer 60 can be selected from any of various rubbers or other elastomers. However, polyurethane resin is preferably used. Thermosetting urethane resin is desirable, preferably having a hardness in the range from 80 to 90 degree (JIS-A). The hardness of the shoe side layer 20 and the wet paper web side layer 60 can be different in order to meet various conditions encountered in the use of the belt. However, in some cases, the hardnesses of the two layers can be the same.

In order to give the shoe press belt a high level of strength in the widthwise direction (cross machine direction), relatively thick and rigid yarn as shown in FIG. 4, can be used for the weft yarns 40B. For example, monofilament yarn, multifilament yarn with a decitex equivalent to 500–1000, or twisted yarn, can be used. The warp yarns crossing these weft yarns only need to provide enough support to maintain the crossing points in proper relation to one another.

The material of the weft yarns 40B is preferably synthetic fiber with a high modulus and high elastic modulus, such as nylon, PET, aromatic polyamide, aromatic polyimide, and high strength polyethylene. These fibers enable the base body to achieve durability and dimensional stability during use the belt, and also provide the durability required during removal of the shoe press belt from the mandrel on which it is formed. It is desirable that the strength of the lattice formed by the weft yarns 40B be in the region of 50–250 kg/cm, and that its 1% modulus be in the region of 5–40 kg/cm. In addition, it is also possible to use inorganic fibers such as carbon fiber or fiberglass etc.

When positioning the lattice material 40 on the external circumference of the shoe side layer 20, it is positioned so that its weft yarns 40B extend parallel to the direction of the axis of the mandrel M. This positioning of the lattice material may be achieved by gradually turning the mandrel M before the shoe side layer 20 is completely cured (that is, while the resin forming the shoe side layer is still glue-like At this time, apparatuses (not shown) for pulling and fixing the lattice material 40 are provided at both ends of the mandrel M. With these apparatuses, the lattice material 40, which usually comprises plural sheets, is gripped by gripping members, and is pulled under a uniform tensile force, and fixed to the shoe side layer.

When the lattice material 40 comprises only one sheet, after adjusting its width to an dimension slightly greater than the circumference of the shoe side layer 20, it is wrapped once around the shoe side layer, and its edges are brought into overlapping relationship in the widthwise direction. When the lattice material 40 comprises plural sheets, it is also important to make sure that edges the sheets overlap one another in the widthwise direction. It is to be noted that the term "overlap" includes a case where the opposing protruding yarns of the adjacent lattice materials not only overlap in the widthwise direction, but also overlap when viewed laterally along the plane formed by the adjacent lattice materials.

For the material of thread 50A, which is used for the wound layer 50, monofilament yarn or multifilament yarn comprising synthetic fiber having high strength, high modulus and high elastic modulus, such as nylon, PET, aromatic polyamide, aromatic polyimide and high strength polyethylene etc. may be used. Twisted yarns composed of any of these materials may also be used.

It is desirable to achieve a strength of the finished product in the range from about 100–300 kg/cm, by winding 10–50 pieces/5 cm when the thread 50A is multifilament comprising nylon or PET (7000 dtex) and by winding 10–30 pieces/5 cm when thread 50A is multifilament comprising aromatic polyamide (3000 dtex).

The wet paper web side layer 60 can be formed after winding the thread 50A to form the wound layer 50, but, as an alternative, it may be formed simultaneously with the winding of thread 50A. After forming the wet paper web side layer 60, the shoe press belt 10 is obtained by curing the resin with heat using heating apparatus (not shown) attached to the mandrel M, further polishing the surface to achieve the desired thickness of the shoe press belt, and finishing by producing concave grooves 70, or blind holes, in the paper web-engaging surface, as required.

Figure 8:
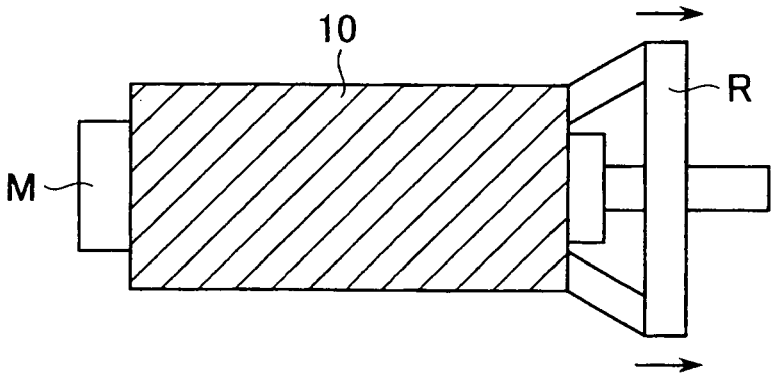
FIG. 8 is a schematic side view illustrating the removal of the formed shoe press belt from the mandrel.

After completion, the shoe press belt 10 is removed from said mandrel M. Removal can be achieved easily by applying a remover or a removing sheet or similar removing member to the surface of the mandrel M before forming the shoe side layer, and by connecting one end of the belt 10 to a ring R, as shown in FIG. 8. The ring R has a diameter larger than that of the mandrel M, and is moved away from the mandrel M utilizing air pressure, water pressure, oil pressure, or dilatation and contraction of resin. In conventional practice removal of a newly formed shoe press belt from a mandrel was carried out using a ring which had almost the same diameter with that of the mandrel M. However, smooth removal of the belt could not be achieved because no consideration was given to the fact that the friction between the ends of the mandrel M and the shoe press belt is very high. However, removal can be carried out easily by fixing one end of the belt to a ring R which has larger diameter than that of the mandrel M, and then removing the ring R from the mandrel.

Examples 1–10 of a shoe press belt according to the invention having the above-described structure, and a comparative example 1, were produced following three processes, which will be explained in detail for Example 1. For the other examples, the differences in the processes will be pointed out.

EXAMPLE 1

In a first process, a remover (KS-61, from Shin-Etsu Chemical Co., Ltd.) was applied to the polished surface of a rotatable mandrel having a diameter of 1500 mm, using an appropriate driving means. Next, a thermosetting urethane resin, and curing agent were mixed. The mixture was composed of a TDI prepolymer (Takenate L2395 from Takeda Chemicals Co., Ltd.) and a curing agent comprising a DMTDA mixture composed of 3,5-dimethylthio-2,4-toluenediamine and 3,5-dimethylthio-2,6-toluenediamine (ETHAUCURE 300 from Albemarle Corporation). The prepolymer and curing agent were mixed with an H/NCO equivalent ratio of 0.97. The mixture was then applied to the surface of the mandrel to a thickness of 1 mm, using a doctor bar while rotating the mandrel. Then, the mandrel was left at room temperature while still rotating. After 10 minutes, the resin was heated to 70 degrees Celsius for 30 minutes to be cured, using a heating apparatus attached to the mandrel.

In a second process, a lattice material made by sandwiching warp yarns and weft yarns, and joining the crossing points of warp yarns and weft yarns with a urethane type resin adhesive. (The density of the weft yarns is shown in table below. The density of the warp yarns is 1 piece/cm for all the examples.) Twisted yarns of multifilament PET fiber having a fiber thickness of 5000 dtex were used both for the warp yarns and the weft yarns. One layer of the lattice material comprising plural sheets was positioned on the external circumference of the shoe side layer in such a way that weft yarns extended axially along the mandrel. The edges of the sheets overlapped one another in the widthwise direction. The wound layer was formed by winding a multifilament PET yarn having a fiber thickness of 7000 dtex in a helix on the external circumference of said lattice material. The pitch of the wound layer is shown in the table. Following winding of the wound layer, the base body was completed by filling with a coating resin to the extent that the gaps between the lattice material and the wound layer were covered.

In a third process, following completion of the base body, the same thermosetting urethane resin used for the shoe side layer was impregnated and coated onto the wound layer top a thickness of 5.5 mm to form the wet paper web side layer. After curing the resin with heat at 100 degrees Celsius for 5 hours, the surface of the wet paper web side layer was polished until the overall thickness of the belt was brought to 5.0 mm. Then concave groove extending in the machine direction of the belt were formed, using a rotating blade.

EXAMPLE 2

In Example 2, the locations of the lattice material and the wound layer in the base body were interchanged. That is, in the second process, after forming a wound layer on the external circumference of the shoe side layer, one layer of lattice material, comprising plural sheets, was positioned on the wound layer in such way that its weft yarns extended along the axial direction of the mandrel, and the edges of the sheets overlapped one another in the widthwise direction.

EXAMPLE 3

In Example 3, in the second process, two layers of lattice material, each comprising plural sheets, were positioned on the external surface of the shoe side layer with their weft yarns extending along the axial direction of the mandrel and their edges overlapping in the widthwise direction. Here the overlapping areas of the outer layer were positioned so that they did not overlap the overlapping sections of the inner layer. The wound layer was formed on the exterior of the outer layer of lattice material.

EXAMPLE 4

In Example 4, in the second process, after forming a wound layer on the external circumference of the shoe side layer, two layers of lattice material, each comprising plural sheets, were placed on the exterior of the wound layer, with their weft yarns extending along the axial direction of the mandrel. Here, as in Example 3, the edges of the sheets in each layer overlapped one another in the widthwise direction, and the overlapping areas of the outer lattice layer were positioned so that they did not overlap the overlapping sections of the inner lattice layer.

EXAMPLE 5

In Example 5, in the second process, a single sheet of lattice material was wound around the shoe side layer in a helix, with the edges of the sheet overlapping in the widthwise direction, and so that the weft yarns of the lattice material extend substantially parallel to the axis of the mandrel. The wound layer was then formed on the external circumference of the lattice layer.

EXAMPLE 6

In Example 6, the locations of the wound layer and the helically wound lattice layer as in Example 5 were interchanged. That is, in the second process, after forming the wound layer on the external circumference of the shoe side layer, a single sheet of lattice material was wound in a in helix over the wound layer, with its edges overlapping.

EXAMPLE 7

In Example 7, in the second process, a first sheet of lattice material was wound in a helix over the shoe side layer with its edges overlapping in the widthwise direction, and then a second sheet of lattice material was wound in a helix over the first helically wound sheet, again with its edges overlapping in the widthwise direction. Then a wound layer was formed on the external circumference of the second helically wound sheet of lattice material.

EXAMPLE 8

In Example 8, in the second process, after forming the wound layer on the external circumference of the shoe side layer, a first layer of lattice material was wound in a helix over the wound layer, with its edges overlapping, and then a second layer of lattice material was wound over the first helically wound layer of lattice material, again with its edges overlapping.

EXAMPLE 9

In Example 9, in the second process, after forming a first wound layer on the external circumference of the shoe side layer, one layer of lattice material comprising plural sheets was positioned on the wound layer in such a way that its weft yarns extended along the axial direction of the mandrel and the edges of the sheets overlapped in the widthwise direction. Then, another wound layer was formed on the external circumference of the lattice layer.

EXAMPLE 10

In Example 10, in the second process, a single sheet of lattice material, having a width slightly greater than the circumference of the shoe side layer, was placed on the external circumference of the shoe side layer, with its weft yarns along the axial direction of the mandrel and with its two edges overlapping each other in the widthwise direction. A first wound layer was then formed on said external circumference of the lattice, and another single sheet of lattice material, having a width slightly greater than the circumference of the shoe side layer, was placed on the external circumference of the first wound layer, with its weft yarns along the axial direction of the mandrel and with its two edges overlapping each other in the widthwise direction. The overlapping portions of the two lattice layers were positioned so that they did not overlap each other. Finally a second wound layer was formed on the external circumference of the outer layer of lattice material.

COMPARATIVE EXAMPLE

Figure 10A:
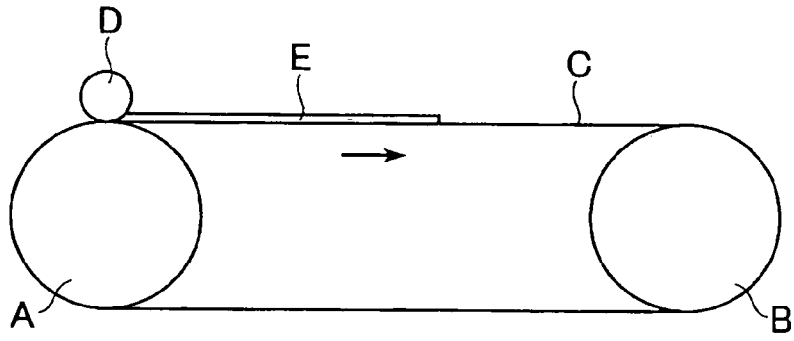
FIG. 10(a) PRIOR ART
FIG. 10(*a*) is a cross-sectional view showing the process of manufacturing a conventional shoe press belt.
Figure 10B:
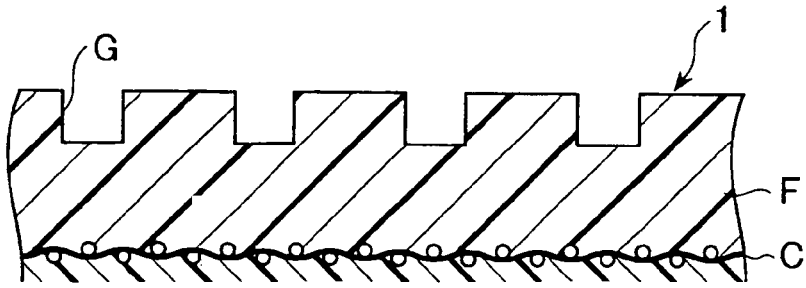
FIG. 10(b) PRIOR ART

In the Comparative Example, as shown in FIGS. 10(*a*) and 10(*b*), an endless woven fabric C was arranged on two rolls, A and B. The surface of the woven fabric, was impregnated with the same thermosetting urethane resin used in Example 1, the resin being applied by coating apparatus D. The resin was then cured by heating. The external circumference of the resin was polished, and the shoe side layer E was formed. Subsequently, after forming the wet paper web side layer F by reversing the shoe side layer E so that it faced inside and the endless woven fabric faced outside, the same thermosetting urethane resin was used to impregnate and coat the now external surface of the woven fabric to form the wet paper web side layer F. The resin forming the web side layer F was cured by heat at 100 degree Celsius for five hours, and then the wet paper web side layer was polished until the overall thickness of the belt was 5.0 mm. Finally, concave grooves G, extending in the machine direction of the belt, were formed using a rotating blade.

Figure 9:
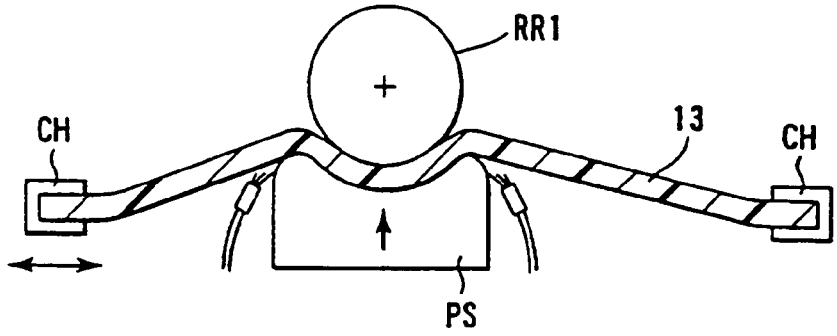
FIG. 9 is a schematic view of an apparatus used for examining crack-resistance.

For all of the examples, physical properties such as cutting strength and crack-resistance were examined. An apparatus used for examining crack-resistance is shown in FIG. 9. In the test apparatus, both edges of the experimental piece 13 are pinched by clamp hands CH, which are interlocked and reciprocally movable in the longitudinal direction. An evaluation surface on the experimental piece 13 faces the rotating roll RR 1, and the experimental piece 13 is compressed by moving press shoe PS toward roll RR 1. With this apparatus, the number of reciprocations before cracking occurs is determined. The tensile force applied to the experimental piece 13 was 3 kg/cm, the pressure was 36 kg/cm$^{2.}$ and the speed of reciprocation was 40 cm/second.

Physical properties such as cutting strength and crack resistance, for Examples 1–10 and the Comparative example, are shown in the table below.

TABLE

| | Thickness (mm) | Hardness (JIS-A) | MD cutting strength (Kg/cm) | CMD cutting strength (Kg/cm) | A number before crack occurs (Unit 10000) | Wefts of lattice shaped material | Thread of wound layer |
|---|---|---|---|---|---|---|---|
| Example 1 | 5.0 | 94 | 220 | 120 | >100 | PET 5000dtex 4 pieces/cm | PET 7000dtex 30 pieces/5 cm |

TABLE-continued

| | Thickness (mm) | Hardness (JIS-A) | MD cutting strength (Kg/cm) | CMD cutting strength (Kg/cm) | A number before crack occurs (Unit 10000) | Wefts of lattice shaped material | Thread of wound layer |
|---|---|---|---|---|---|---|---|
| Example 2 | 5.0 | 95 | 220 | 120 | 70~80 | PET 5000dtex 4 pieces/cm | PET 7000dtex 30 pieces/5 cm |
| Example 3 | 5.0 | 94 | 230 | 160 | >100 | PET 5000dtex 3 pieces/cm | PET 7000dtex 30 pieces/5 cm |
| Example 4 | 5.1 | 94 | 230 | 160 | 50~60 | PET 5000dtex 3 pieces/cm | PET 7000dtex 30 pieces/5 cm |
| Example 5 | 5.0 | 93 | 230 | 100 | >100 | PET 5000dtex 4 pieces/cm | PET 7000dtex 30 pieces/5 cm |
| Example 6 | 5.0 | 94 | 230 | 100 | 70~80 | PET 5000dtex 4 pieces/cm | PET 7000dtex 30 pieces/5 cm |
| Example 7 | 5.0 | 94 | 230 | 140 | 60~70 | PET 5000dtex 3 pieces/cm | PET 7000dtex 30 pieces/5 cm |
| Example 8 | 5.1 | 94 | 230 | 140 | 50~60 | PET 5000dtex 3 pieces/cm | PET 7000dtex 30 pieces/5 cm |
| Example 9 | 5.0 | 94 | 260 | 120 | >100 | PET 5000dtex 4 pieces/cm | PET 7000dtex 18 pieces/5 cm |
| Example 10 | 5.0 | 94 | 260 | 140 | 70~80 | PET 5000dtex 3 pieces/cm | PET 7000dtex 18 pieces/5 cm |
| Comparative Example | 5.0 | 94 | 210 | 120 | 30~40 | | |

The data in the table show that the Examples according to the invention have excellent crack-resistance in comparison with the Comparative example. The Examples may have superior crack resistance because the base body of the Comparative example comprises a woven fabric wherein undulations of the warp yarns and weft yarns are relatively large, allowing cracks to occur more easily, whereas the base bodies of the Examples in accordance with the invention comprise a lattice material as a component, wherein the crossing points of the warp yarns and weft yarns are joined and undulations of the warp yarns and weft yarns are relatively small.

According to the invention as described above, undulations of the warp yarns and weft yarns can be made relatively small by using, as a component of the base body, a lattice material made by joining the crossing points of the warp yarns and weft yarns. By doing so, the occurrences of cracks in the resin layers during use of the belt can be prevented, and the durability of the belt is improved. In addition, since there is no need to form thread in the direction of the mandrel in order to form the base body, a remarkable improvement in productivity can be realized.

Further, it is advantageous that no displacement of the crossing points occurs when the lattice material is wound on the mandrel, since the yarns are bonded at the crossing points.

What is claimed is:

1. A belt for use in a shoe press wherein the belt passes between a press roll and a shoe, the belt comprising a base body, a wet paper web side layer on one side of the base body and a shoe side layer on the opposite side of the base body, in which said shoe side layer is formed on a mandrel having a polished surface, and said base body comprises a lattice material comprising warp yarns and weft yarns crossing one another at crossing points and joined at said crossing points, and a layer comprising thread wound in a helix.

2. A shoe press belt as claimed in claim 1, wherein said warp yarns are pinched by said weft yarns, and the warp and weft yarns are joined at said crossing points by an adhesive comprising a resin or by thermal bond.

3. A shoe press belt as claimed in claim 1, wherein the weft yarns of said lattice material have a higher strength than that of said warp yarns, and said weft yarns extend along the axial direction of the mandrel during the formation of the belt.

4. A shoe press belt as claimed in claim 1, wherein the number of said weft yarns of said lattice material is more than double the number of said warp yarns in said lattice material, and said weft yarns extend along the axial direction of the mandrel during the formation of the belt.

5. A shoe press belt as claimed in claim 2, wherein the weft yarns of said lattice material have a higher strength than that of said warp yarns, and said weft yarns extend along the axial direction of the mandrel during the formation of the belt.

6. A shoe press belt as claimed in claim 2, wherein the number of said weft yarns of said lattice material is more than double the number of said warp yarns in said lattice material, and said weft yarns extend along the axial direction of the mandrel during the formation of the belt.

7. A shoe press belt as claimed in claim 1, wherein said lattice material is wound onto said mandrel in a helix.

8. A shoe press belt as claimed in claim 2, wherein said lattice material is wound onto said mandrel in a helix.

9. A shoe press belt as claimed in claim 1, wherein sheets of said lattice material, having length and width, are positioned on said mandrel with edges of said sheets overlapping one another in the widthwise direction.

10. A shoe press belt as claimed in claim 2, wherein sheets of said lattice material, having length and width, are positioned on said mandrel with edges of said sheets overlapping one another in the widthwise direction.

11. A shoe press belt as claimed in claim 3, wherein sheets of said lattice material, having length and width, are positioned on said mandrel with edges of said sheets overlapping one another in the widthwise direction.

12. A shoe press belt as claimed in claim 4, wherein sheets of said lattice material, having length and width, are positioned on said mandrel with edges of said sheets overlapping one another in the widthwise direction.

13. A shoe press belt as claimed in claim 5, wherein sheets of said lattice material, having length and width, are positioned on said mandrel with edges of said sheets overlapping one another in the widthwise direction.

14. A shoe press belt as claimed in claim 6, wherein sheets of said lattice material, having length and width, are positioned on said mandrel with edges of said sheets overlapping one another in the widthwise direction.

15. A shoe press belt as claimed in claim 7, wherein sheets of said lattice material, having length and width, are positioned on said mandrel with edges of said sheets overlapping one another in the widthwise direction.

16. A shoe press belt as claimed in claim 8, wherein sheets of said lattice material, having length and width, are positioned on said mandrel with edges of said sheets overlapping one another in the widthwise direction.

17. A method of making a belt for use in a shoe press wherein the belt passes between a press roll and a shoe, comprising:

forming a shoe-side layer on a mandrel having a polished surface;

forming a base body on the shoe side layer while the shoe side layer is on the mandrel, by placing, around the mandrel, a lattice material comprising warp yarns and weft yarns crossing one another at crossing points and joined at said crossing points, and also winding thread in a helix about the mandrel; and forming a wet paper web side layer on said base body.

18. A method according to claim 17, in which the mandrel is in the form of a cylinder having an axis, and in which the weft yarns of the lattice material extend along the axial direction of the mandrel.

19. A method according to claim 18, in which the strength of the weft yarns is higher than the strength of the warp yarns.

20. A method according to claim 17, in which the step of placing the lattice shaped material around the mandrel is carried out by placing sheets of said lattice material, having length and width, on mandrel, with edges of said sheets overlapping one another in the widthwise direction.

* * * * *